United States Patent [19]

Meyering et al.

[11] 4,320,846

[45] Mar. 23, 1982

[54] STORING OR PACKING DEVICE COMPRISING A NUMBER OF SEPARATE CONTAINER ELEMENTS

[75] Inventors: Samuel Meyering, Amsterdam; Engelbertus J. van der Molen, Krommenie, both of Netherlands

[73] Assignee: Vandermolen B.V., Purmerend, Netherlands

[21] Appl. No.: 87,158

[22] Filed: Oct. 22, 1979

[30] Foreign Application Priority Data

Nov. 2, 1978 [NL] Netherlands ..... 7810935
Aug. 31, 1979 [BE] Belgium ..... 196977

[51] Int. Cl.[3] ..... B65D 37/00; B65D 85/67

[52] U.S. Cl. ..... 220/20; 150/52 R; 206/390; 206/820; 220/23.4; 220/23.8

[58] Field of Search ..... 220/20, 23.8, 23.83, 220/23.86, 23.4; 206/234, 349, 45.11, 390, 820; 150/52 R

[56] References Cited

U.S. PATENT DOCUMENTS

| | | | |
|---|---|---|---|
| 2,565,167 | 8/1951 | Bres | 150/52 R |
| 3,072,280 | 1/1963 | Spardo | 220/23.4 |
| 3,245,528 | 4/1966 | Holley | 220/23.8 |
| 3,311,229 | 3/1967 | Troll | 206/390 |
| 3,319,685 | 5/1967 | Urban | 150/52 R |
| 3,605,374 | 9/1971 | Mueller | 206/390 |
| 3,835,992 | 9/1974 | Adams | 206/820 |
| 3,986,299 | 10/1976 | Merzweiler | 220/23.8 |

*Primary Examiner*—George E. Lowrance
*Attorney, Agent, or Firm*—Holman & Stern

[57] ABSTRACT

A device for storing or packing loose objects comprising a plurality of container elements, each having a bottom wall, upstanding side and end walls, and an open upper side, which elements are connected to one another by hinge joints arranged between the side edges of the bottom walls thereof to form a continuous row of elements and which elements are so shaped and dimensioned that this row of elements, from its extended position, can be spirally rolled-up into a block of prismatic form in which the open upper element sides are closed-off by wall portions of other elements lying inwardly thereof in said block and engaging said open sides.

24 Claims, 11 Drawing Figures

STORING OR PACKING DEVICE COMPRISING A NUMBER OF SEPARATE CONTAINER ELEMENTS

BRIEF SUMMARY OF THE INVENTION

The invention relates to a device for storing or packing loose objects. More particularly, the invention relates to such a storing or packing device of the kind comprising a plurality of container elements each including a base wall having parallel edges and end and side walls extending upwardly from the base wall, which container elements are connected to one another by hinged joints therebetween arranged at the parallel base wall edges to form a continuous row of container elements, such that said row of elements from its flat extended position with said container elements resting on their respective base walls, can be folded together by a rolling-up movement to form a substantially closed prismatic block.

In a known packing device of this general type (see the German "Offenlegungsschrift" No. 1.536.138) the separate container elements serve for the packing of fluid or granular matter, each container element having a pouring orifice in an end wall thereof but being otherwise of completely closed design. The container elements of this prior art device have a triangular section such that they can be folded together into a prismatic block of square or hexagonal section, in which the container elements lie against each other with their sloping sides and with their tops meeting at the centre of the block, the outwardly directed base walls of the container elements being connected to each other by welded hinge joints along the ribs of the block so formed. After unfolding or unrolling of the row of container elements, the separate elements of the row can be torn off along the hingable joints therebetween for separate use.

The object of the present invention is to provide a storing or packing device of the above described kind which is suitable for continuous use as a storage box having a large number of easily accessible compartments in which objects of divergent character can be stored.

In the device according to the invention, the container elements have cross-sectional shapes so adapted to one another that the row of elements, in the extended position thereof, can be spirally rolled-up from one end of the row to form a block of prismatic form, and at least the majority of the container elements have open upper sides opposite their base walls or bottom walls, which open upper element sides in the rolled-up position of the row of container elements are closed-off by wall portions of other elements lying inwardly thereof in said spirally wound block and engaging said open sides.

Thus a storage box is obtained which has a compact block-like form and an attractive exterior in its rolled-up state and which, in its unrolled position, exposes the contents of all the container elements in a convenient manner. When spirally rolling-up the extended row of container elements, the open upper sides of the horizontally disposed elements are each successively covered-off by a wall portion or portions of one or more preceding elements which have already been rolled-up in the spiral block being formed whereby the contents of the container elements cannot escape therefrom. When unrolling the row of container elements on the other hand, the elements are returned one by one to their horizontal position with the open side thereof uppermost.

The uprollable and unrollable storage box of the invention can be used for various purposes, such as for the storage of screws, nuts and other small technical items, or as a sewing box, cigar and cigarette box, bandage box, a tool box or the like.

It is important that in the process of rolling-up or unrolling the row of container elements the portion of the row which has already been rolled up or is being unrolled, respectively, should maintain its closed coherent state, and that, therefore, this rolled-up row portion should only be allowed to swing as a whole about the hinge axis between it and the adjacent element resting flat on its bottom wall without the possibility that elements in said rolled-up portion could prematurely swing open about other, higher located hinges since in that case the contents of such elements could fall out.

In order to prevent or at least oppose such premature opening of the spirally wound row of container elements or part of such row, and as an important aspect of the invention, the container elements are preferably provided with cooperating detent means so arranged that in the rolled-up position of the row of container elements, a detent means on each one element and a complementary detent means on another element lying against the upper side thereof in the spirally wound block interengage in a manner to allow only a relative turning movement about the hinge axis between said first mentioned element and the next following element in the unrolling direction of the row while preventing a relative turning movement about any of the other hinge axes of the rolled-up portion of the spiral block of elements.

The spirally wound prismatic block can have five or more sides and preferably is hexagonal. This hexagonal design of the storage box of the invention provides a favourable compromise since, on the one hand, the angle between the sloping sides and the bottom of the container elements is not too small, i.e. an angle of 60°, whilst on the other hand in a rolled-up block of a practical size the widths of the container elements, as determined by the number of the sides of the block, will not be too small.

In another embodiment, the block has a right-angled, and preferably a square cross-sectional form. In that case, the storage box may be so formed that in the rolled-up position of the row of container elements the open upper side of at least some of the elements is covered-off by the bottom wall of the element lying inwardly thereof and by one or two side walls of adjoining elements co-extensive with said bottom wall.

According to a further preferred embodiment of the invention, the outer side wall of the container element at the outer end of the row of elements and the bottom wall of an element adjoining said side wall in the spirally wound block are provided with co-operating locking members, such as the parts of a snap-closure with finger grip. Furthermore, preferably the container element which in the block is situated on the side thereof, opposite the container element at the outer end of the rolled-up row of container elements, has a sunken handgrip formed therein. Thus, the storage box can be picked up and carried in the rolled-up state and through this arrangement it is ensured that in setting the box down it comes to rest on said outer element of the row of container elements and thus in the correct position for opening the box.

BRIEF DESCRIPTION OF THE SEVERAL VIEWS OF THE DRAWINGS

The invention will be more readily understood and the further objects and advantages thereof will be more apparent when read in conjunction with the accompanying drawings showing preferred embodiments of the invention. In the drawings.

DETAILED DESCRIPTION

Figure 1:
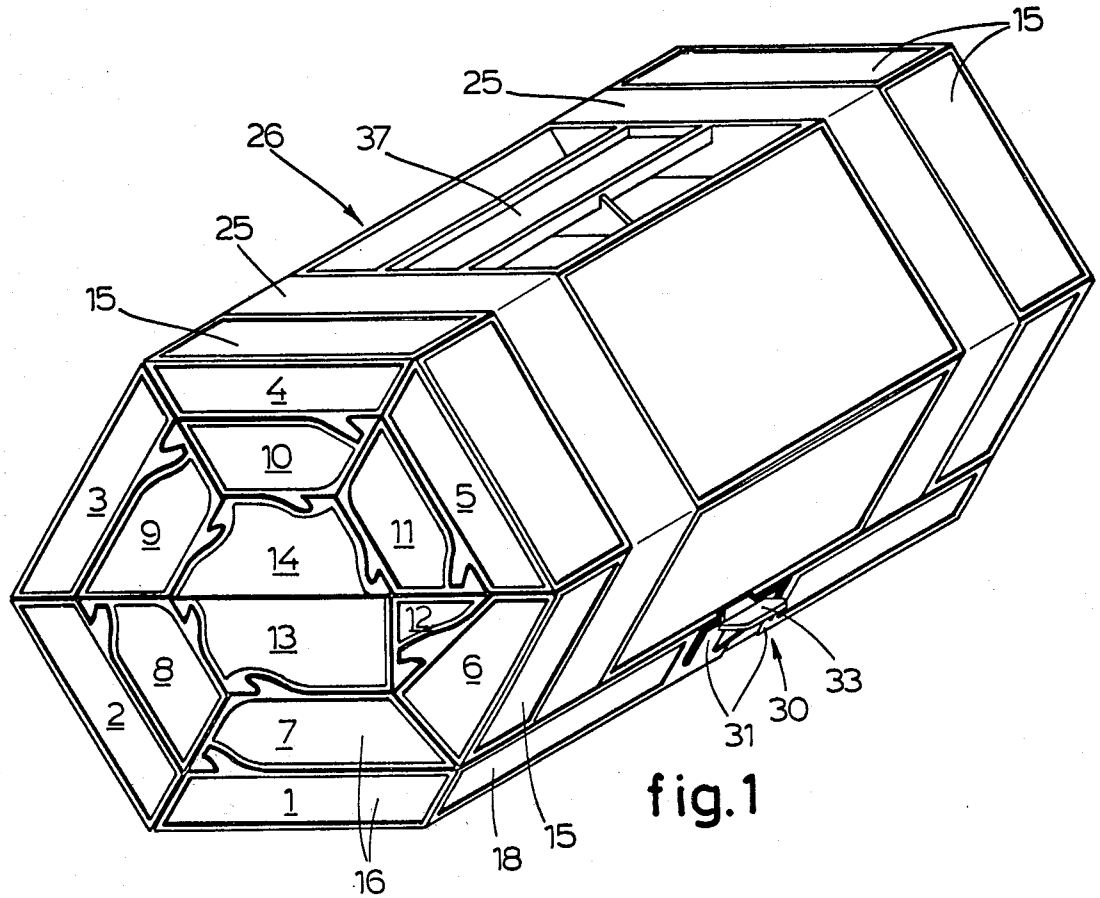
FIG. 1 is a perspective view of a first embodiment of the device according to the invention forming a storage box which, in the rolled-up state, has the shape of a regular hexagonal prismatic block.

The storage box illustrated in FIGS. 1–4 comprises a row of mutually hinge-connected oblong container elements 1–14 of equal length but of differing cross-sections. The container elements each have a flat rectangular bottom wall 15 and end walls 16 extending vertically upward therefrom, which end walls determine the different basic sectional forms of the container elements. The sectional form of the first container element is that of a parallelogram and that of the mutually alike container elements 2–5 is trapezoidal, the upstanding edges of the end walls of these elements all forming angles of 60° with the bottom wall 15. The container element 6 forms a transition to container elements 7–11 which have a greater height because of which the cross-section of the container element 6 has an irregular four-sided form, whereas the elements 7–11 again have a trapezoidal form. The container element 12 has a triangular form whilst the container elements 13 and 14 have again differing cross-sections, these latter elements, in a manner yet to be described, forming the core of the block when the container elements have been rolled up. The container elements are open on their upper sides and have vertical side walls 17 which connect at the upper corner points of the end walls 16 and consequently join the bottom walls 15 at a short distance from the side edges thereof. The container element side walls 17 are reinforced on the outside thereof by triangular supports 20.

At the end of the row of container elements, the container element 1 has an outwardly inclined outer wall 18 and between this outer wall 18 and the adjacent vertical inner side wall there are formed a number of small compartments and a closure member yet to be described. The container element 13 has a vertical side wall 19 connected on one side to the edge of its bottom wall and an outwardly sloping side wall 18 on its other side whilst the container element 14 has two outwardly sloping side walls 18 (FIG. 4). As may be seen in FIG. 3, the container elements may be divided longitudinally into compartments by vertical cross-partitions 21 which, as shown, are preferably removably arranged with their end portions slidably fitting in grooves formed between fillets 22 formed on the concerned side walls 20.

The container elements 1–13 are hingably joined to one another at the adjoining longitudinal edges of the bottom walls 15 thereof by suitable hinge connections of which the pivot axes are indicated by 23, whilst the container elements 13 and 14 are joined along the upper edge of their adjoining, outwardly sloping, side walls 18 by a hinge connection with pivotal axis 24. Through this arrangement, the container elements are successively linked together to form a continuous row thereof. In the illustrated embodiment, the hinge connections between the container elements are constituted by flexible strips 25 (FIGS. 1 and 2), which strips run parallel to one another across the undersides of the bottom walls 15 of the container elements in recesses provided therefor in the latter and to which they are adhesively fixed. Further, these strips 25 extend over each of the adjoining side walls 18 of the container elements 13 and 14.

Figure 3:
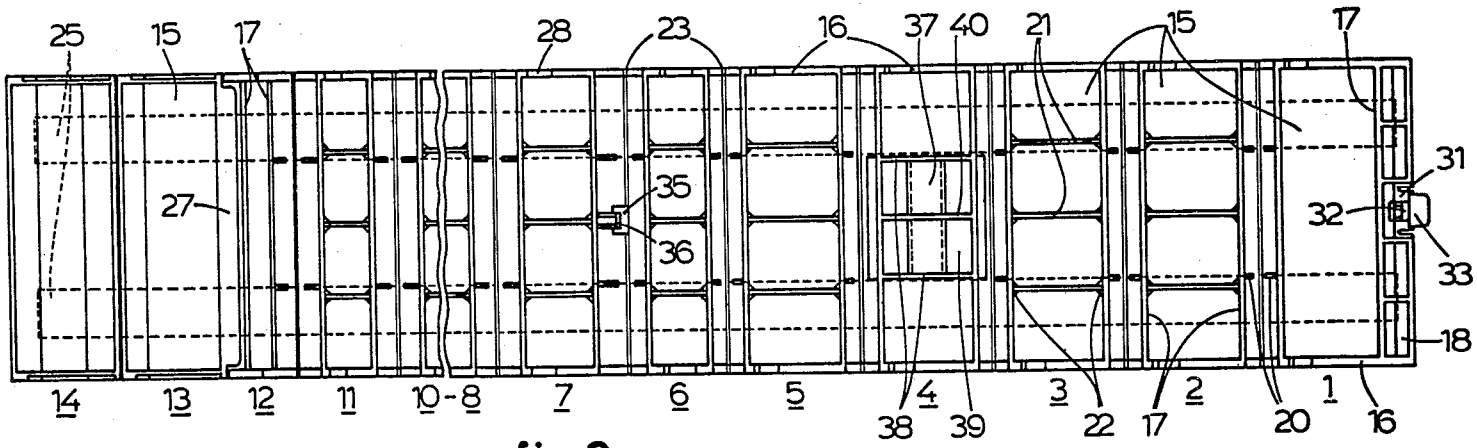
FIG. 3 is a plan-view of the box of FIG. 1 in the completely unrolled state and in which several of the container elements have been left out.
Figure 4:
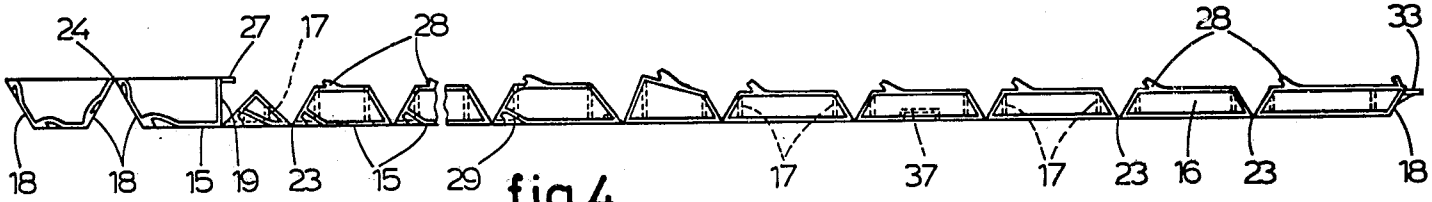
FIG. 4 is a side-view of the row of container elements of FIG. 3.

The transverse dimensions and sectional forms of the container elements 1–14 or the end walls 16 thereof, respectively, are chosen such that the initial linearly extended row of container elements, as illustrated in FIGS. 3 and 4, can be rolled-up spirally into the form of a closed block 26 of regular hexagonal prismatic form as illustrated in FIG. 1. In achieving this, first the container element 14 is pivoted on the hinge axis 24 to fittingly engage with the open upper side of the container element 13, which elements 14 and 13 have a greater height than the other container elements 1–12 and in this position form together the core, or the innermost winding of the spirally wound block. Thus the container elements 13 and 14, when configuratively engaging one another by their open sides, enclose a relatively large space which can serve as storage space for one or more larger objects. Should it be desired, however, it is possible to provide the container element 14 with a folding lid in order to form a separate storage space therein.

The subsequent second winding of the spiral comprises the small container element 12 of triangular cross-section, which serves as a filler element, and the following container elements 11, 10, 9 and 8 which are mutually alike and have a trapezoidal cross-section. This second winding terminates with the trapezoidal container element 7 which has a greater width than the container elements 11–8. On rolling up, the perpendicular side wall 19 of the container element 13 comes to lie against the adjoining sloping side edges of the container element 12 whilst a sideways extending lip 27 formed on this side wall 19 engages with the upper edge of the rear side wall 17 of the container element 12. Through this, the small space in the container element 12 is covered-off on its upper side. The triangular end walls of this container element 12 extend above the side walls 17 of this element. By further rolling-up of the row of elements, the open upper sides of the container elements 11, 10 and 9 are respectively and configuratively covered-off by the outermost side wall 18 of the container element 14, the bottom wall 15 of the latter element and the other sloping side wall 18 of this element 14, whilst the container elements 8 and 7 are covered-off by the sloping side wall of the container element 13 and the bottom wall 15 of this last element 13, respectively (FIG. 1).

The outermost winding of the spiral comprises the transitory container element 6, the mutually alike container elements 5, 4, 3 and 2 of trapezoidal form and the container element 1 on the outermost end of the row of container elements. Due to the fact that the container elements 11–8 of the second spiral winding have a smaller width than the container elements 5–1 of the outermost winding, the elements 11–8 have been given a greater height in order that these elements 11–8 may have a sufficiently large, usable and spatially practical content. The transitory container element 6 has sloping sides of different heights which correspond respectively to the sloping adjoining side of the higher container element 7 and of the lower container element 5, whilst the upper edge of the container element 6 slopes with respect to the bottom wall 15 of this element. By rolling-up this last winding of the spiral, the open upper sides of the container elements 6, 5, 4, 3, 2 and 1 are configuratively covered-off by the bottom wall of the container elements 12, 11, 10, 9, 8 and 7, respectively. The outwardly sloping outermost side wall 18 of the last container element 1 lies in the plane of the outwardly directed face of the bottom wall 15 of the container element 6 (FIG. 1). The bottom walls 15 of the container elements 5, 4, 3, 2 and 1 constitute five side surfaces of the so formed closed block 26, whilst the sixth side surface of this block is consequently formed by the said outwardly sloping outermost side wall 18 of the container element 1 and the bottom wall 15 of the shorter transitory container element 6. It will be seen in FIG. 1 that the adjoining sides of the container elements of the second and third spiral windings coincide with radial planes which extend to the ribs of the block 26 in five cases, whilst the only exception hereto are the adjoining sides of the container elements 6 and 7.

Figure 2:
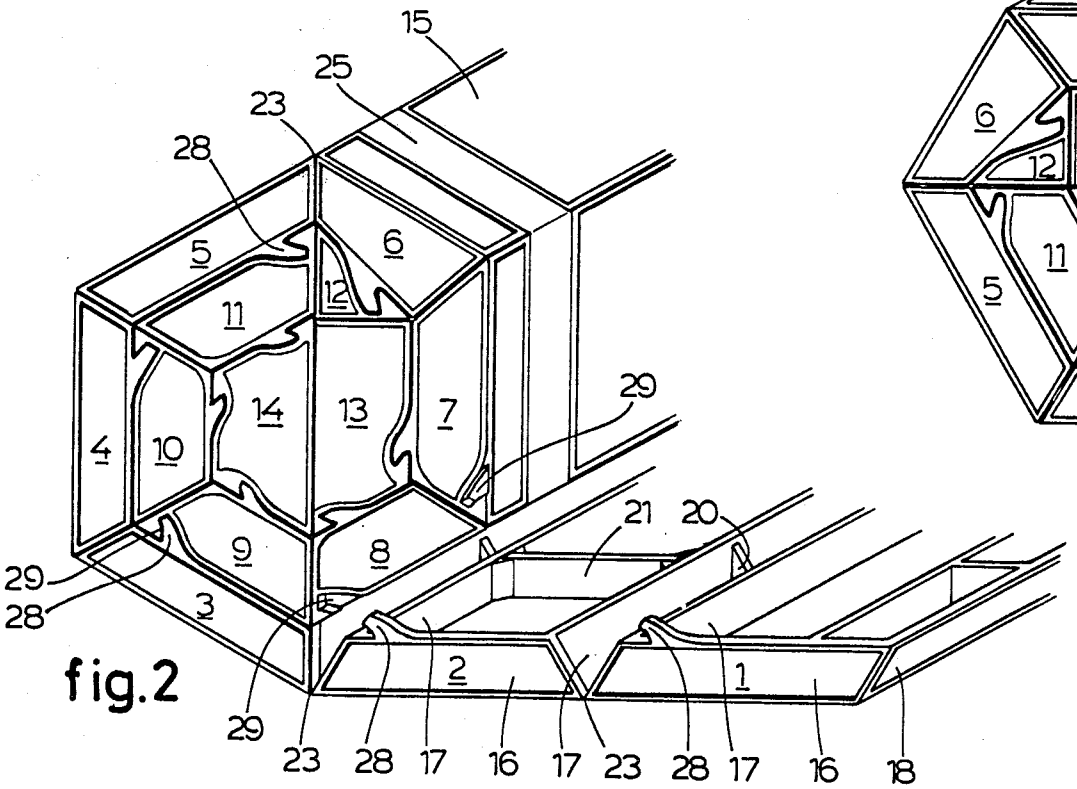
FIG. 2 is a perspective view of the box of FIG. 1 in a partly unrolled state.

For a proper functioning of the described storage box, it is of importance that, during unrolling of the block, the spiral windings of the as yet unrolled portion of the block cannot prematurely open and that during rolling-up of the row of container elements, the already rolled-up container elements cannot again move away from one another. FIG. 2 shows the situation during the unrolling of the row of container elements onto a flat supporting surface, the elements 1 and 2 having already been unrolled and the remaining portion of the element block being rotated outward about the axis of the hinge 23 between container elements 2 and 3 until this element 3 also rests on the supporting surface. In this intermediate position, shown in FIG. 2, only the pivoting movement about the hinge axis 23 between the container elements 2 and 3 should be possible and a pivoting movement between two other container elements, for example about the hinge axis 23 between the elements 5 and 6, should not be allowed since in that case the still rolled-up portion of the spiral winding could spread whereby the contents of the container elements of this rolled-up portion could fall out. In order to prevent this premature opening, a curved projection or detent 28 is formed on the upper edges of each of the end walls 16 of the container elements, which detent extends obliquely upwardly in the direction in which the row of container elements is unrolled and which detent 28, in the rolled-up position of the row, is fittingly received in a recess or groove 29 formed in the underside of the corresponding end wall 16 of the container element situated radially inwardly thereof. The curvature of the detent 28 and the associated groove 29 has a centre point which lies on the hinge axis 23 between the element carrying the detent and the container element adjoining the same in the unrolling direction. As seen in FIG. 2, in the process of unrolling the still spirally wound portion of the block of container elements by rotating this block portion about the hinge axis 23 between the elements 2 and 3, the detent 28 of container element 2 has just been disengaged from its associated groove 29 in container element 8 which disengagement was possible by the fact that the centre point of the curvature of the associated detent 28 and groove 29 lies on the hinge axis 23 between the elements 2 and 3. From FIG. 2 it will also be seen that the detents 28 and grooves 29 between the other container elements of the still rolled-up portion of the block hold such container elements together and effectively prevent the premature opening of the spiral windings.

Figure 6:
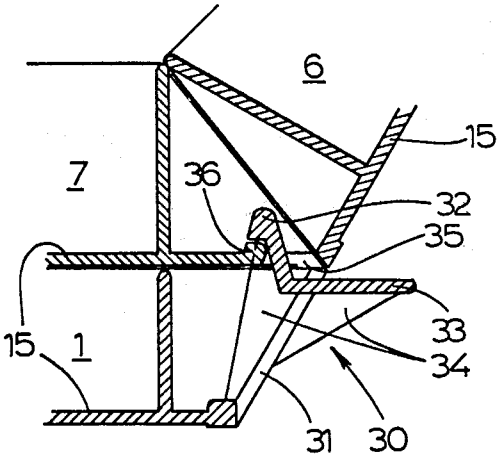
FIG. 6 shows, on an enlarged scale, a cross-section of a closure means for the box of FIG. 1.

A snap-closure 30 (FIGS. 1 and 6) is formed in the centre of the outwardly directed side wall 18 of the outermost container element 1 of the row of elements. To this end, this side wall 18 is provided with notches extending downwardly from the upper edge thereof to form resilient lips 31 connected at their lower ends to the bottom wall 15 of the container element 1. These lips 31 support an inwardly extending hook portion 32 and a sideways extending finger-grip 33 both further secured to the lips by flat reinforcing portions 34. The hook portion 32 extends into an opening 35 in the edge of the bottom wall 15 of the container element 7 and, in its closed condition, grips over a thickened edge portion 36 of this opening 35. By pushing the grip 33 down with a finger, the lips 31 can be resiliently bent to lift the hook portion 32 from the edge portion 36, so that the box can be opened to unroll the container elements. When rolling-up the row of container elements, the enlarged edge portion 36 of the opening 35 can move past the foreside of the hook portion 36 pushing the latter upward until the hook portion 36 snaps back over the edge 36 to secure the outermost container element 1.

A hand-grip 37 (FIGS. 1 and 3) is formed in the container element 4 which lies opposite the outermost container element 1 in the rolled-up block 26. To this end, an opening 39 is provided in the bottom wall 15 of the container element 4 and enclosed between transversely arranged walls 39, which opening is midway longitudinally spanned by the beam-shaped hand-grip 37. The hand-grip 37 can be further reinforced by the provision of an intermediate cross-wall 40. If the closed block-shaped box 26 is picked up by the hand-grip 37 to carry the same and is then again put down, it will thus automatically come to rest on the outermost container element 1 in the correct position for opening the box and unrolling the container elements thereof.

Figure 5:
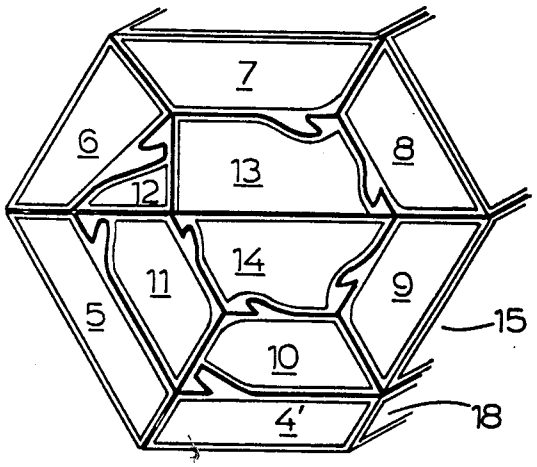
FIG. 5 is a front-view of a modification of the box of FIG. 1 in which the row of container elements has an irregular hexagonal prismatic form in the rolled-up state.

FIG. 5 shows a variation of the embodiment of the box of FIG. 1. The box of FIG. 5 has a smaller number of container elements and can be considered as obtained from the box of FIG. 1 by leaving out the container elements 1, 2 and 3 and by replacing the container element 4 with a container element 4′ of which the outermost side wall 18 slopes outwardly to lie in the plane of the bottom wall 15 of the container element 9. In this arrangement, the rolled-up row of elements forms a hexagonal prismatic block, which block, however, has unequal sides but a vertically plane of symmetry in the position shown in FIG. 5. In this case the closure means 30, not shown in FIG. 5, is arranged between the side wall 18 of the container element 4′ and the bottom wall 14 of the container element 10 lying thereagainst, and the hand-grip 37, likewise not shown in FIG. 5, is arranged in the bottom wall of the uppermost lying container element 7. Furthermore, the detent grooves 29 of the container elements 7, 8 and 9 can, of course, be dispensed with.

Figure 9:
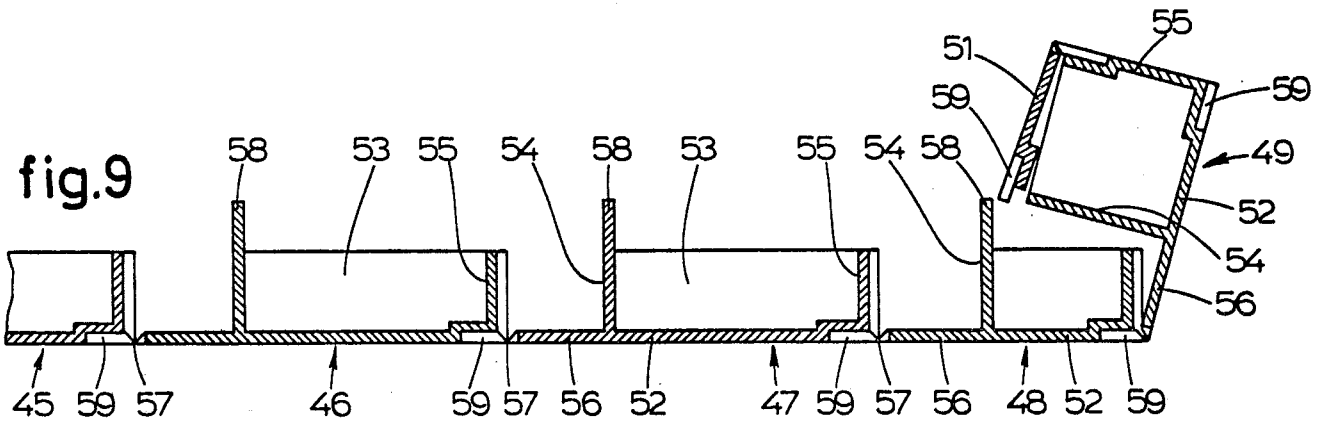
FIG. 9 is a longitudinal cross-section of a portion of the row of container elements of the box of FIG. 7 shown in a partially unrolled state.
Figure 7:
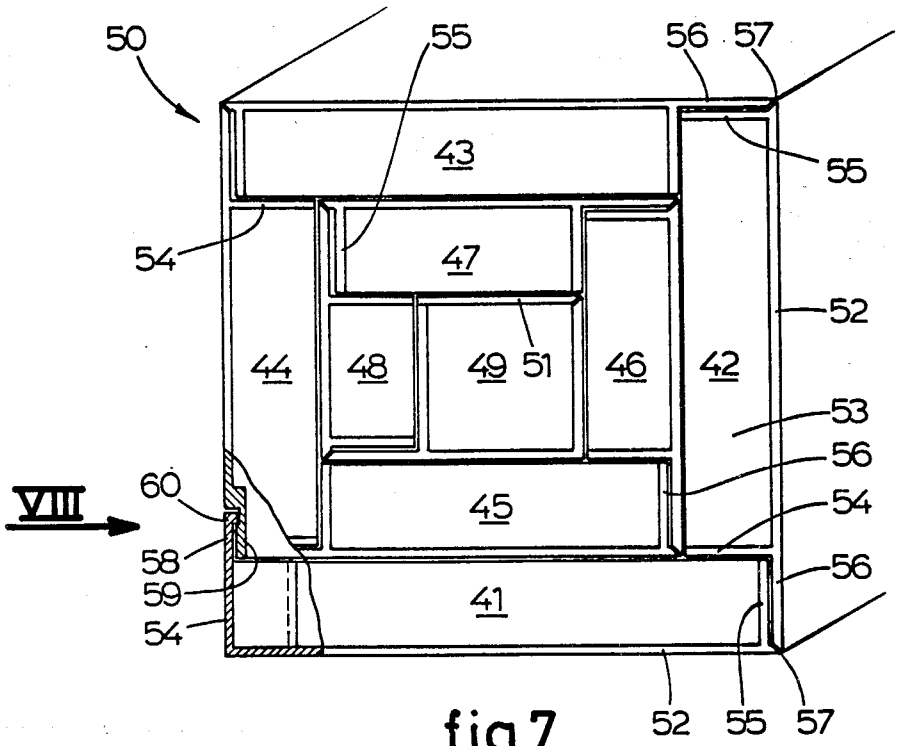
FIG. 7 is an end view of another embodiment of the device in which the row of container elements forms a block of square cross-section in the rolled-up state thereof.
Figure 8:
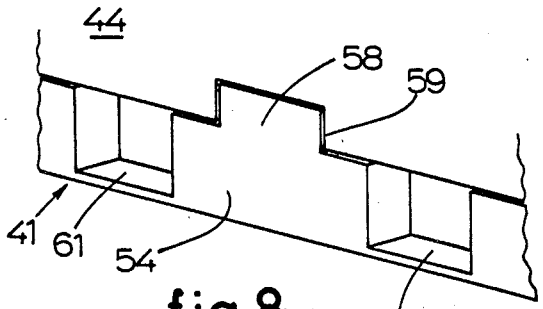
FIG. 8 is a front-view of a portion of the box of FIG. 7 as viewed in the direction indicated by the arrow VIII in FIG. 7.

FIGS. 7, 8 and 9 illustrate an embodiment of the invention which is particularly suitable for use as a packing box for screws, nails and similar objects in assortments of different forms and sizes, which box the purchaser, if he so desires, can also continue to use as a storage box. This embodiment forms, in its rolled-up condition, a prismatic block 50 of a square cross-section assembled from container elements 41–48 of rectangular box-like form of mutually alike heights and lengths but with different widths, and a core forming container element 49 for the spiral windings having a square cross-section, the side lengths of which are twice that of the shortest sides of the other container elements and further having a closable lid 51. The container elements are manufactured from a transparent synthetic material, and each has a bottom wall 52, end walls 53, and side walls 54 and 55 extending perpendicularly upward from the bottom wall 52. The bottom wall 52 of each of the container elements 41–49 extends on one side beyond the side wall 54 of the element with a portion 56 thereof having a length equal to the height of the container elements 41–48. These container elements are again hingably connected to one another to form a row of container elements (FIG. 9) which hinge connections in this case consist of film-hinges 57 formed between and along the longitudinal edge of an extending bottom wall portion 56 of a container element and the longitudinal edge of a bottom wall 52 of the container element lying next thereto in the rolling-up direction. The row of so joined container elements can thus be manufactured as one-piece by injection moulding.

It will be seen from FIGS. 7 and 9 that on rolling-up an extended row of container elements, beginning from the container element 49 forming the core of the block 50, the extending bottom wall portion 56 of a preceding container element comes to lie against the outer side of the side wall 57 of the following container element, and the side wall 54 of said preceding container element comes to lie on the open upper side of said following container element. The open upper side of the second container element 48 is configuratively covered-off by the side wall 54 of the first container element 49, whilst the mutually alike elements 47 and 46 have a greater width such that their upper sides are covered-off by the cover 51 of the first container element 49 and the side wall 54 of the preceding container element 48, and the side wall 55 of the first container element 49 and the side wall 54 of the container element 47, respectively. The then following container elements 45 and 44 again have the same width and are covered-off on their upper sides by the side wall 54 of the preceding container element, the bottom wall 52 of the container element 49 or 48, respectively, lying inwardly thereof, and the extending bottom wall portion 56 of this last mentioned element or, if this portion 56 is absent when another type of hinge connection is used, by the side wall 55 of the container element 48 or 47, respectively, adjoining this bottom wall 52. The mutually alike container elements 43 and 42 again have a greater width than the container elements 45 and 44 and cover-off these last two container elements in a similar manner, whilst the outermost container element 41 of the row has the greatest width of all and which width is equal dimensionally to the side of the block 50 so formed. In this embodiment the detent members for impeding premature opening of the spiral windings of the formed block 50 comprise tongues 58 which are formed on the side walls 54 of the container elements and extend upward midway from the upper edges of these side walls. Each of the detent tongues 58 fits into a corresponding recess 59 arranged in the bottom wall of the container element, which comes to lie in the rolled-up condition of the row of FIG. 7, in the plane of the concerned side wall 54 with detent lip 58. For instance, as appear from FIGS. 7 and 8, the detent lip 58 on the side wall 54 of the outermost element 41 of the row of elements fits into the recess 59 arranged in the bottom wall of the container element 44. As will be seen from FIG. 7, this detent lip 58 does not impede the pivoting action of the container element 42 with respect to container element 41 about the axis of the hinge 57 connecting these elements, but it does impede the outward pivoting action of that portion of the block 50 formed by container elements 43–49 about the axis of the upper-right lying hinge 57 between the container elements 42 and 43. The detent tongue 58 of the element 48 fits into the recess 59 which is arranged in the lid 51 of the innermost container element 49.

An enlarged and inwardly extending edge 60 is formed on the detent lip 58 of the outermost container element 41. This enlarged edge 60 resiliently engages in a corresponding groove formed in the bottom of the recess 59 in the container element 44 and thus holds the box together in the rolled-up condition. Two spaced cavities 61 are formed (see also FIG. 8) in the side wall 54 of this outermost container element 41, into which cavities two fingers can be inserted on opening the box in order to restrain movement of the underlying container element 41 if the remaining rolled-up portion of the box must be turned open about the axis of the lower right-hand hinge 57 against the spring action of the snap closure 59 and 60 at the beginning of the unrolling movement.

Figure 11:
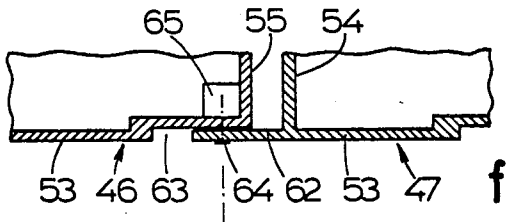
FIG. 11 is a plan-view of the hinge connection of FIG. 10.
Figure 10:
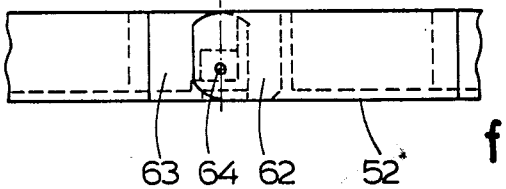
FIG. 10 is a side view of another embodiment of the hinge connection between the elements of a box such as illustrated in FIG. 7.

FIGS. 10 and 11 show that, instead of the film-hinges 57, hinge connections of other type can be used between the container elements of the packing box of FIGS. 7–9. This is illustrated in FIGS. 10 and 11 by the hinge connection between container elements 46 and 47. In comparison with FIG. 9, it will be noted that the bottom wall 52 of the container elements 47 has no extending portion in this case but terminates at the side wall 54. Both the end walls 53 of the container element 47 however have a portion 62 projecting beyond the side wall 54, which projecting portions 62 form hinge-plates which lie in recesses 63 in the side walls 53 of the adjoining container element 46 to which they are joined by hinge-pins 64. To reinforce the hinge connection, the hinge-pins 64 are taken up in enlarged block-like portions 65 which are formed in the concerned corners of the container element 46. It will be clear that such hinge connections will be arranged between all container elements of the row and that, if so desired, hinge connections of this type could also be employed in the embodiment shown in FIG. 1.

The above described storing and packing boxes can be manufactured from a suitable synthetic material and produced by an injection moulding process.

While the invention has been illustrated and described with reference to specific embodiments thereof, it will be understood that other embodiments may be resorted to within the scope of the following claims.

What is claimed is:

1. A device for storing or packing loose objects, comprising a plurality of substantially rigid container elements of equal length and of varying width, each of said elements including a flat bottom wall having substantially parallel side edges, and end walls and side walls extending upwardly from said bottom wall, said end walls and side walls of at least the majority of said elements having upper edges situated in a common flat plane and defining the element upper side, and hinge means hingedly interconnecting said plurality of container elements so as to form a unitary continuous row of said elements, at least the majority of said hinge means being arranged at said bottom wall parallel side edges of said elements, said row of hingedly interconnected container elements having a first end and a second end and said element row being moveable between a first extended open position in which said container elements rest on their bottom walls with said element upper sides turned upwardly, and a second, rolled-up closed position in which said element row, starting from said first end thereof has been spirally rolled-up from said first position to form a substantially closed block of prismatic shape and comprising polygonal convolutions, in which block each element, except for said first element, at its side turned towards said first element, is in abutting relation to the adjacent element hingedly connected thereto, and in which block each of said majority of elements of varying widths has its said upper side matingly engaged and covered by at least one pre-determined wall portion of corresponding size of at least one element situated radially inwardly thereof.

2. A device as defined in claim 1 in which said spirally would prismatic block has at least five side faces and in which at least a majority of said container elements open upper sides are completely covered by a single continuous wall of a container element situated radially inwardly thereof in said block.

3. The device of claim 2 in which said single continuous wall is the bottom wall of said radially inwardly situated container element.

4. The device of claim 2 in which said single continuous wall is a side wall of said radially inwardly situated container element.

5. A device as defined in claim 1 in which said bottom wall of the outermost container element of said row of elements situated at said second end of said row, in the rolled-up state of said row, forms a side face of said prismatic block, one of said side walls of said outermost element facing outwardly at said second row end and forming, in said spirally wound block, part of a second side face of said block adjoining said first mentioned side face.

6. A device as defined in claim 2, in which said end walls of at least the majority of said container elements of said row have substantially a trapezoidal form, said side walls of said elements extending upwardly perpendicularly to said bottom wall thereof and terminating substantially at the upper corner points of said trapezoidal end walls.

7. A device as defined in claim 1, in which the first two container elements at said first end of said row of elements are hingedly connected to each other by hinge means arranged at the upper edges of the adjoining side walls of said two elements, whereby, when rolling-up said row of elements from said first row end, said two elements can be folded one against the other with their upper sides in mating engagement.

8. A device as defined in claim 1, further comprising cooperating detent means provided on said container elements, said detent means being so formed and arranged that in the rolled-up position of the row of container elements, a detent means on each one of said elements and a complementary detent means on another one of said elements lying against the upper side of said first mentioned element in the spirally wound block interengage in a manner to allow when unrolling said block, only a relative turning movement about the hinge axis of said hinge means between said first mentioned element and the next following element in the unrolling direction of the row while preventing a relative turning movement about the hinge axes of the hinge means between other elements in that portion of the block which is still rolled-up.

9. A device as defined in claim 1, further comprising releasable locking means operating on the outermost container element at said second end of said row of elements to prevent accidental unrolling of said row of elements in the rolled-up state thereof.

10. Device of claim 9, in which said locking means comprises a snap closure comprising two cooperating locking members adapted to resiliently and lockingly interengage in the rolled-up position of said row of elements, one of said locking members being provided on the upper edge of the outwardly facing side wall of said outermost container element and the other of said locking members being formed in the bottom wall of the container element adjoining said side outer wall in the rolled-up position of said row.

11. A device as defined in claim 1, in which at least some of said container elements have at least one partition wall removably mounted therein and extending between said side walls.

12. A device as defined in claim 1, in which said hinge means comprise hinge plate members formed by lateral extensions of said end walls of said container elements, and hinge pins connecting said hinge plate members of one element to the corresponding end walls of the adjacent element of said row.

13. A device for storing or packing loose objects, comprising a plurality of container elements, each of said elements including a bottom wall having substantially parallel side edges, and end walls and side walls extending upwardly from said bottom wall, at least the majority of said plurality of container elements having open upper sides opposite said bottom wall, and hinge means hingedly interconnecting said plurality of container elements at said bottom wall parallel side edges of the latter so as to form a unitary continuous row of said elements, said row having a first end and a second end, said respective container elements having cross-sectional shapes so adapted to one another that said row of hingedly connected container elements, in the extended position thereof with the container elements resting on their said bottom walls, can be spirally rolled up from said first end of said extended row into a substantially closed block of prismatic hexagonal shape in which each of said open upper element sides is matingly covered-off by a wall of a container element situated radially inwardly thereof in said spirally wound block, each of said container elements, except the first two elements at said first end of said row of elements, comprising a curved projection extending upwardly from the upper edge of at least one of said two end walls of the element, said projection, in the rolled-up position of the row of elements, being fittingly received in a corresponding recess formed in the lower side of the corresponding end wall of a container element lying inwardly of and abutting said first mentioned projection carrying element in the spirally wound block, said projections and grooves being shaped so as to engage one another when said row of elements is rolled up and to disengage when said row of elements is unrolled.

14. A device for storing or packing loose objects, comprising a plurality of container elements, each of said elements including a bottom wall having substantially parallel side edges, and end walls and side walls extending upwardly from said bottom wall, at least the majority of said plurality of container elements having open upper sides opposite said bottom wall, and hinge means hingedly interconnecting said plurality of container elements at said bottom wall parallel side edges of the latter so as to form a unitary continuous row of said elements, said row having a first end and a second end, said respective container elements having cross-sectional shapes so adapted to one another that said row of hingedly connected container elements, in the extended position thereof with the container elements resting on their said bottom walls, can be spirally rolled up from said first end of said extended row into a substantially closed block of prismatic form in which said open upper element sides are closed-off by wall portions of other container elements lying inwardly thereof in said spirally wound block and engaging said open sides, the container elements constituting the outer winding of said spirally rolled-up row of elements forming said prismatic block having a height which is smaller than the height of the container elements of the adjoining winding inwardly of said outer winding, said row of elements comprising a container element forming a transitory element between said two windings having its open upper side situated in a plane which slopes from one side wall of said transitory element having said first mentioned smaller height to the opposite element side wall having said last mentioned greater height.

15. A device for storing or packing loose objects, comprising a plurality of container elements, each of said elements including a bottom wall having substantially parallel side edges, and end walls and side walls extending upwardly from said bottom wall, at least the majority of said plurality of container elements having open upper sides opposite said bottom wall, and hinge means hingedly interconnecting said plurality of container elements at said bottom wall parallel side edges of the latter so as to form a unitary continuous row of said elements, said row having a first end and a second end, said respective container elements having cross-sectional shapes so adapted to one another that said row of hingedly connected container elements, in the extended position thereof with the container elements resting on their side bottom walls, can be spirally rolled up from said first end of said extended row into a substantially closed block of prismatic form in which said open upper element sides are closed-off by wall portions of other container elements lying inwardly thereof in said spirally wound block and engaging said open sides, and cooperating detent means provided on said container elements comprising a curved projection extending from the upper edge of at least one of said end walls of each container element, and a groove adapted to accommodate said projection provided in the lower side of the corresponding end wall of a container element lying inwardly against said first element in the spirally wound block, the center point of the curvature of the projection and the accommodating groove therefor lying at least approximately on the axis of the hinge means between the first mentioned element and the adjoining element in the unrolling direction of the row of elements, said projections and grooves being interengageable to allow, when unrolling said block, only a relative turning movement about the hinge axis of said hinge means between said first mentioned element and the next following element in the unrolling direction of the row while preventing a relative turning movement about the hinge axes of the hinge means between other elements in that portion of the block which is still rolled-up.

16. A device for storing or packing loose objects, comprising a plurality of container elements, each of said elements including a bottom wall having substantially parallel side edges, and end walls and side walls extending upwardly from said bottom wall, at least the majority of said plurality of container elements having open upper sides opposite said bottom wall, and hinge means hingedly interconnecting said plurality of container elements at said bottom wall parallel side edges of the latter so as to form a unitary continuous row of said elements, said row having a first end and a second end, said respective container elements having cross-sectional shapes so adapted to one another that said row of hingedly connected container elements, in the extended position thereof with the container elements resting on their said bottom walls, can be spirally rolled up from said first end of said extended row into a substantially closed block of prismatic form in which said open upper element sides are closed-off by wall portions of other container elements lying inwardly thereof in said spirally wound block and engaging said open sides, and releasable locking means operating on the outermost container element at said second end of said row of elements to prevent accidental unrolling of said row of elements in the rolled-up state thereof comprising a snap closure having two cooperating locking members adapted to resiliently and lockingly interengage in the rolled-up position of said row of elements, one of said locking members being provided on the upper edge of the outwardly facing side wall of said outermost container element and the other of said locking members being formed in the bottom wall of the container element adjoining said side outer wall in the rolled-up position of said row, and an outwardly projecting finger grip on said one of said locking members for disengaging said locking members.

17. A device for storing or packing loose objects, comprising a plurality of container elements, each of said elements including a bottom wall having substantially parallel side edges, and end walls and side walls extending upwardly from said bottom wall, at least the majority of said plurality of container elements having open upper sides opposite said bottom wall, and hinge means hingedly interconnecting said plurality of container elements at said bottom wall parallel side edges of the latter so as to form a unitary continuous row of said elements, said row having a first end and a second end, said respective container elements having cross-sectional shapes so adapted to one another that said row of hingedly connected container elements, in the extended position thereof with the container elements resting on their said bottom walls, can be spirally rolled up from said first end of said extended row into a substantially closed block of prismatic form in which said open upper element sides are closed-off by wall portions of other container elements lying inwardly thereof in said spirally wound block and engaging said open sides, releasable locking means operating on the outermost container element at said second end of said row of elements to prevent accidental unrolling of said row of elements in the rolled-up state, and a hand grip mounted in a recess formed in the bottom wall of the container element which, in said spirally wound block, is situated on the side of said block opposite from said outermost container element whereby said block can be carried in a position in which said outermost block faces downwardly.

18. A device for storing or packing loose objects, comprising a plurality of container elements, each of said elements including a bottom wall having substantially parallel side edges, and end walls and side walls extending upwardly from said bottom wall, at least the majority of said plurality of container elements having open upper sides opposite said bottom wall, and hinge means hingedly interconnecting said plurality of container elements at said bottom wall parallel side edges of the latter so as to form a unitary continuous row of said elements, said row having a first end and a second end, said respective container elements having cross-sectional shapes so adapted to one another that said row of hingedly connected container elements, in the extended position thereof with the container elements resting on their said bottom walls, can be spirally rolled up from said first end of said extended row into a substantially closed block of prismatic form in which said open upper element sides are closed-off by wall portions of other container elements lying inwardly thereof in said spirally wound block and engaging said open sides, said prismatic block having a right-angled, in particular square cross-sectional shape in which, in the rolled-up position of said row of container elements, the open upper side of an element is covered-off by at least two co-extensive walls of at least two other adjoining elements abutting said open side.

19. The device of claim 18, in which one of said abutting walls is the bottom wall of one other element and the other of said walls is a side wall of an element adjoining said other element.

20. The device of claim 18, in which said element open upper side is covered-off by the bottom wall of one other element and by side walls of two further elements adjoining said other element on both sides thereof.

21. The device of claim 18, in which each of said container elements, except the first element at said first end of said row of elements, has a tongue member extending upwardly from the side wall of the element facing away from said first row end, said tongue members fitting in a corresponding tongue-receiving recess formed in the bottom wall of the element which, in the rolled-up position of the row of elements, lies with its said bottom wall in the same plane as said side wall.

22. The device of claim 18, in which the first container element at said first end of said row of elements has substantially twice the height of the other container elements of said row, said first element being provided with a lid.

23. The device of claim 18, in which said bottom walls of said container elements each extend at one side thereof beyond the associated element side wall over a distance which corresponds to the height of said container elements, said hinge means comprising flexible film-hinge members integral with said bottomwalls and each connecting the outer edge of said extending bottom wall portion of one container element and the adjoining edge of the bottom wall of the adjacent container element of said row of elements.

24. A device for storing or packing loose objects, comprising a plurality of container elements, each of said elements including a bottom wall having substantially parallel side edges, and end walls and side walls extending upwardly from said bottom wall, at least the majority of said plurality of container elements having open upper sides opposite said bottom wall, and hinge means comprising a plurality of spaced parallel flexible strips affixed to the undersides of said container elements and extending lengthwise of said row of elements hingedly interconnecting said plurality of container elements at said bottom wall parallel side edges of the latter so as to form a unitary continuous row of said elements, said row having a first end and a second end, said respective container elements having cross-sectional shapes so adapted to one another that said row of hingedly connected container elements, in the extended position thereof with the container elements resting on their said bottom walls, can be spirally rolled up from said first end of said extended row into a substantially closed block of prismatic form in which said open upper element sides are closed-off by wall portions of other container elements lying inwardly thereof in said spirally wound block and engaging said open sides.

* * * * *